United States Patent [19]

Fadler née Jack et al.

[11] 4,023,925

[45] May 17, 1977

[54] PROCESS FOR OBTAINING MULTICOLOR EFFECTS

[75] Inventors: Birgid Fadler née Jack, Hattersheim (Main); Hans-Peter Maier, Sulzbach, Taunus, both of Germany

[73] Assignee: Hoechst Aktiengesellschaft, Frankfurt am Main, Germany

[22] Filed: Aug. 14, 1974

[21] Appl. No.: 497,484

[30] Foreign Application Priority Data

Aug. 16, 1973 Germany ..... 2341427

[52] U.S. Cl. ..... 8/21 C; 8/15; 8/39 C; 8/41 C

[51] Int. Cl.[2] ..... D06P 3/82

[58] Field of Search ..... 8/15, 21 C, 39 C, 41 C

[56] References Cited

UNITED STATES PATENTS

| | | | |
|---|---|---|---|
| 1,926,086 | 3/1931 | Dreyfus | 8/15 X |
| 2,475,672 | 7/1949 | Mellor et al. | 8/15 |
| 3,382,607 | 5/1968 | Ryan et al. | 46/156 |

FOREIGN PATENTS OR APPLICATIONS

| | | | |
|---|---|---|---|
| 197,779 | 5/1958 | Austria | 8/15 |

*Primary Examiner*—William F. Hamroch
*Attorney, Agent, or Firm*—Curtis, Morris & Safford

[57] ABSTRACT

Process for obtaining multicolor effects on textiles made of polyester fibers and blends thereof with cellulosic fibers, by locally applying an aqueous solution of alkaline agents, either thickened or not and free from oxidizing or reducing agents, onto a dried or partially dehydrated unfixed pad-dyeing produced on said fiber material using a disperse dyestuff of the general formulae hereinafter described, allowing the solution to act on the dyeing, thermosoling the material to fix the dyestuff and finishing it in the usual manner.

7 Claims, No Drawings

PROCESS FOR OBTAINING MULTICOLOR EFFECTS

The present invention relates to a process for obtaining multicolor effects.

Known methods for obtaining multicolor effects on flat textile material are printing methods, such as the direct printing, resist printing and discharge printing methods. In the direct printing, one or more printing pastes containing a fixable dyestuff are printed on mostly undyed textiles. According to the discharge printing method, printing pastes containing reducing or oxidizing agents which, in a subsequent thermal process, destroy the bottom dyeing, are applied to predyed material. When the printing paste also contains dyestuffs which are resistant to the discharge agents and are fixable on the fiber, color effects are obtained. In the resist printing method, the fixation of a pre-padded or cross-padded dyestuff is locally prevented by printing resist agents, having a chemical or mechanical action, onto the material. In this case, the color effects are obtained by adding to the printing paste dyestuffs which are fixable even in the presence of a resist agent.

Further methods for producing multicolor effects on textiles are a dropwise application of dyeliquors, application by means of doctor blades, spraying, foaming and the like, followed by a thermal fixation operation. This type of dyestuff application for obtaining preferably irregular multicolor effects corresponds, on principle, to the direct printing method and is being practiced nowadays especially for dyeing carpets and similar pile-type articles.

It is moreover known that disperse dyestuffs have a more or less marked sensitivity toward alkaline agents, which is a handicap in the single-bath dyeing technique. The process of this invention, however, makes use of this very sensitivity of disperse dyes toward alkalis.

It has now been found that optionally irregular multicolor effects can be produced on textiles made of polyester fibers, preferably blended with cellulosic fibers, by locally applying a thickened or unthickened aqueous solution of alkaline agents, which does not contain an oxidizing or reducing agent, onto a partly dehydrated or dried unfixed pad-dyeing obtained on such a fibrous material using a disperse dyestuff of the general formula

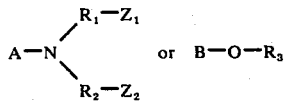

in which

A stands for a mono- or disazo dyestuff residue, $R_1$ for a direct bond, $—CH_2—$ or $—C_2H_4—$, $R_2$ for $—CH_2—$ or $—C_2H_4—$, $Z_1$ for —H, —OH, —CN or $—OOC—CH_3$, $Z_2$ for —H,

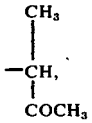

—CN, $—OOC—CH_3$ or $—C_6H_5$,

B for an amino-hydroxy-anthraquinone radical which may be halogenated or not, and $R_3$ stands for —H, an aryl or alkyl group which is linked to the anthraquinone derivative via an ether bridge, preferably in 2-position, allowing this solution to act on the dyeing, then thermosoling the material to fix the dyestuff and finishing in the usual manner.

According to the process of the invention, the strong alkaline liquor is applied onto the material by dropwise or flow application, by spraying, printing, painting-on, foaming or doctoring in parts.

As alkaline agents, hydroxides, carbonates or triphosphates of alkali metals and mixtures thereof in an aqueous solution are used, preferably sodium hydroxide or sodium carbonate, especially in a concentration of 1 to 25 g/l of sodium hydroxide or 1 to 20 g/l of sodium carbonate (anhydrous), or mixtures of these two compounds within the range as indicated. Equivalent amounts of potassium hydroxide or carbonate may also be used. The pH-value of these solutions measured at 20° C is always in the range of from 10.5 to 14.

The alkaline liquors to be applied dropwise are at any event free reducing or oxidizing discharge agents. The alkaline liquiors used are not thickened or thickened to a minor extent, using 0 to 8 g/l of etherified carbohydrates, for example starch or cellulose ether. The thickening brings about an intensification of contrasts. Where required, hydrotropic chemicals, for example polyalkylene glycols, may also be added.

Moreover, reactive dyestuffs may also be added to the alkaline liquors. The padding liquors may likewise contain, in addition to the disperse dyes, reactive dyestuffs. These additives are to be used especially for the dyeing of polyester/cellulosic fiber blends.

The alkaline agent applied according to the invention onto the unfixed bottom pad-dyeing destroys the physical and chemical structure of the said disperse dyestuff types, thus preventing their fixation on the polyester fiber during the subsequent thermosoling operation. The area which has been treated with the alkaline liquor is brightened to such an extent that, depending on the dyestuff used, the concentration of alkali and on the thermosoling conditions, tone-in-tone dyeings or shades ranging to almost white are obtained in patterns of varying shape, preferably of annular shape.

It is surprising that disperse dyes capable of being discharged by means of reducing agents are less, or not at all, suitable for the brightening process of the invention using alkalis, whilst dyestuffs which are resistant to discharge with reducing agents allow good brightening effects to be obtained, that is to say they behave in a manner contrary to experience.

When the padding liquor contains as well disperse as reactive dyestuffs, the reactive dyestuff is fixed on the area treated with alkalis and the disperse dyestuff is brightened. Hence, a (preferably ring-shaped) effect having diffused outlines is obtained, which shows the color of the reactive dye on the treated area and that of the disperse dye in the bottom.

When the padding liquor made of disperse and reactive dyes also contains a weak alkaline agent (for example, sodium bicarbonate), the reactive dyestuff is fixed in addition to the disperse dye even on the untreated areas during the thermosoling operation. The bottom then shows the shades of the two components; in case of different shades, a bicolor effect appears on the two fiber portions.

In this case, the alkali-treated areas show the shade of the reactive dyestuff alone.

When the alkaline liquor to be applied dropwise also contains a reactive dyestuff, the area treated with this liquor shows the shade of the reactive dye even if there is no reactive dyestuff in the padding liquor. Thus, a great variety of melanging, overlapping and diffusion effects can be achieved by varying the composition of the padding and alkaline liquors.

Although blends of polyester and cellulosic fibers offer a larger number of possible designs, due to the fact that reactive dyes can additionally be used, the alkaline liquors may also be applied onto unblended polyester fibers, using disperse dyes alone. When alkali-resistant disperse dyes are added to the alkaline liquors, color effects may as well be obtained in addition to the brightening effect.

The thermosoling operation for the fixation of the disperse dyes is carried out in known manner, preferably using dry heat, at temperatures of from 180° to 230° C.

The disperse and reactive dyes to be used are the known products as compiled and listed, for example, under the terms "Disperse Dyes" and "Reactive Dyes" in Colour Index, 3rd Edition, Volumes 2 and 3, respectively.

The following Examples illustrate the invention.

EXAMPLE 1

A blended fabric made of polyester fibers and cotton (in a ratio of 67 : 33) was padded at room temperature and a liquor pick-up of 70% (calculated on the weight of the dry material) in a padding machine with an aqueous liquor containing, per liter, 15 g of the disperse dyestuff of the formula

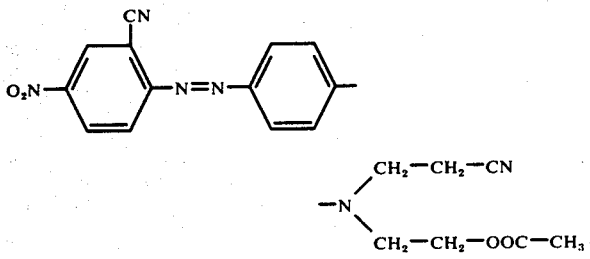

and 20 g of the reactive dyestuff of the formula

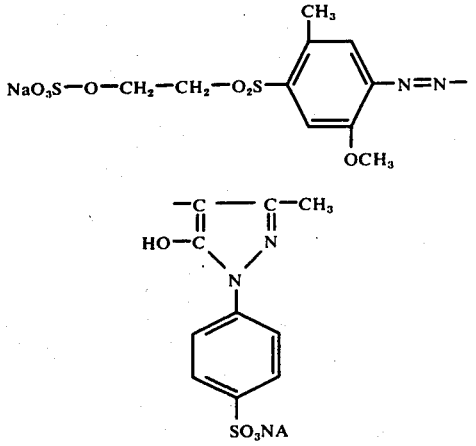

The material thus treated was dried at 100° C, and an aqueous liquor containing 6.6 g/l of sodium hydroxide was applied dropwise and irregularly. The material was then thermosoled for 60 seconds at 200° C, rinsed on an open-width washing device and soaped.

Circle- and ring-shaped light yellow effects on a red bottom were obtained.

EXAMPLE 2

Dyeing was performed as disclosed in Example 2 using a padding liquor which contained, per liter, 20 g of the disperse dyestuff of the formula

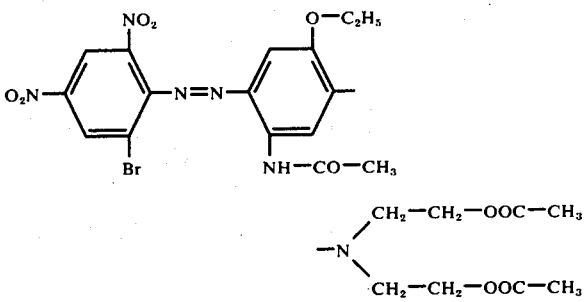

25 g of the reactive dyestuff of the formula

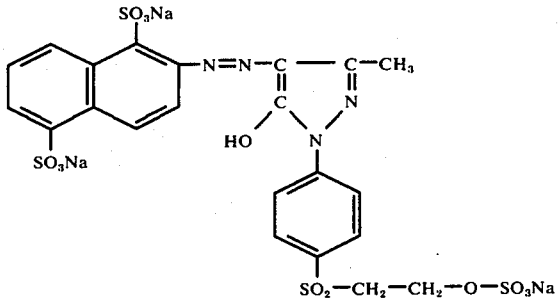

and 5 g of sodium bicarbonate.

The liquor to be applied dropwise contained, per liter, 6.6 g of sodium hydroxide and 3 g of fully etherified starch.

Circular or ring-shaped light yellow effects were obtained on a green bicolor bottom, showing diffuse green outlines.

EXAMPLE 3

Dyeing was performed as disclosed in Example 1 using a padding liquor which contained, per liter, 30 g of the disperse dyestuff of the formula

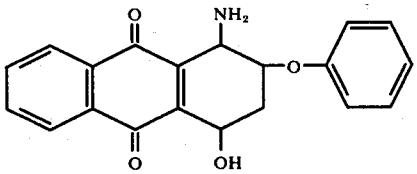

20 g of the reactive dyestuff of the formula

Cu—Pc—

-continued

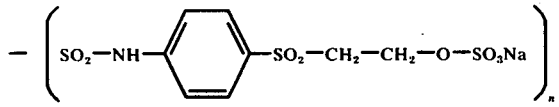

[Cu – Pc = copper phthalocyanine
n = 1 or 2]

and 5 g of sodium bicarbonate.

The alkaline liquors to be applied dropwise contained, per liter, a.
10 g of sodium carbonate,
6.6 g of sodium hydroxide and
3 g of a fully etherified starch;

b.
as sub (a) and
10 g of the reactive dyestuff cited in Example 2.

Ring-shaped effects were obtained, having diffused outlines in turquois shade, when liquor (a) was used, and in green shade, when liquor (b) was used, on a violet bicolor bottom.

EXAMPLE 4

Dyeing was performed as disclosed in Example 1 using a padding liquor which contained, per liter,
20 g of the disperse dyestuff of the formula

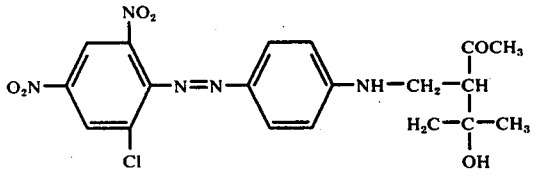

20 g of the reactive dyestuff mentioned in Example 2 and
5 g of sodium bicarbonate.

The liquor to be applied dropwise contained, per liter,
20 g of sodium carbonate,
15 g of polyethylene glycol (molecular weight 600) and
3 g of a fully etherified starch.

Ring-shaped yellow effects having blotted outlines on a green bicolor bottom were obtained.

EXAMPLE 5

Dyeing was performed as disclosed in Example 1 using a padding liquor which contained, per liter,
20 g of the disperse dyestuff of the formula

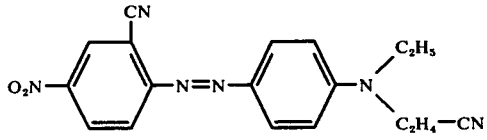

20 g of the reactive dyestuff indicated in Example 1, and the alkaline liquor to be applied dropwise contained, per liter,
6.6 g of sodium hydroxide,
3.4 g of an alkane sulfonate having 12 to 17 carbon atoms in the alkyl moiety, and
2.2 g of the reaction product of 1 mol of isotridecanol with 5 mols of ethylene oxide.

Ring-shaped yellow flow effects on a red bottom were obtained.

EXAMPLE 6

Dyeing was performed as disclosed in Example 1 using a padding liquor which contained, per liter,
30 g of the disperse dyestuff of the formula

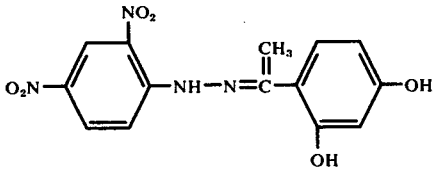

the alkaline liquors to be applied dropwise contained, per liter, a.
6.6 g of sodium hydroxide,
1.5 g of a fully etherified starch,
3.4 g of an alkane sulfonate having 12 to 17 carbon atoms in the alkyl moiety, and
2.2 g of the reaction product of 1 mol of isotridecanol with 5 mols of ethylene oxide;

b.
the same constituents as sub (a) and
20 g of the reactive dyestuff mentioned in Example 3.

With liquor (a), ring-shaped brightening effects and with liquor (b), overlapping effects ranging from green to turquosis were obtained.

EXAMPLE 7

Dyeing was performed as disclosed in Exaple 1 using a padding liquor which contained, per liter, 30 g of the disperse dyestuff of the formula

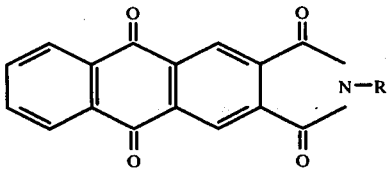

in which R stands for a lower alkyl group,
15 g of the reactive dyestuff mentioned in Example 2, and the alkaline liquors to be applied dropwise contained, per liter a.
15 g of sodium carbonate (anhydrous) and
5.6 g of the hydrotropic mixture of auxiliaries specified in Examples 4, 5 and 6;

b.
the same constituents as sub (a) and
20 g of the disperse dyestuff of the formula

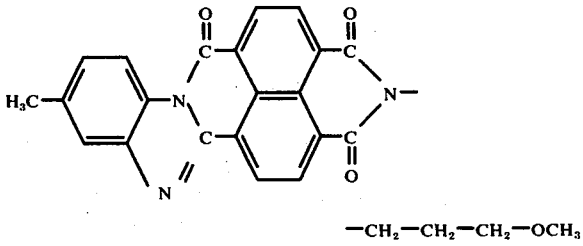

c.

the same constituents as sub (a) and 20 g of the disperse dyestuff of the formula

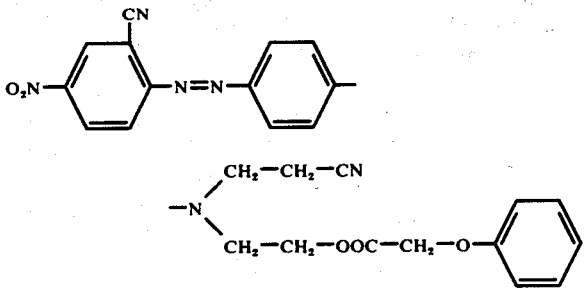

Orange-yellow and red color effects having diffused outlines on a green bicolor bottom were obtained.

EXAMPLE 8

Dyeing was performed as disclosed in Example 1 using a padding liquor which contained, per liter, 20 g of the disperse dyestuff of the formula

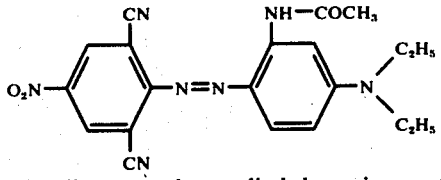

the alkaline liquors to be applied dropwise contained, per liter, a.

5 g of sodium carbonate, 6.6 g of sodium hydroxide, 3 g of a fully etherified starch and 15 g of polyethylene glycol having a molecular weight of 600;

b.

the same constituents as sub (a) and 20 g of the reactive dyestuff of the formula

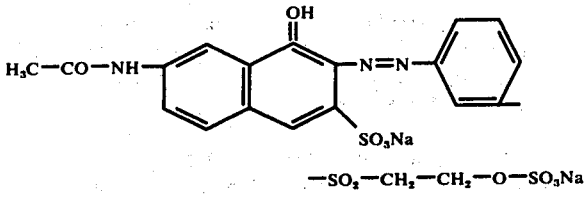

With liquor (a), brightening effects were obtained and with liquor (b), red color effects having peripheral diffusion and overlapping outlines on a blue bottom were obtained.

We claim:

1. A process for obtaining multicolor effects on textiles made of polyester fibers and blends thereof with cellulosic fibers by modifying the disperse dye to be applied, which comprises locally applying an aqueous solution of an alkaline agent selected from the group consisting of hydroxides, carbonates or triphosphates of alkali metals and mixtures thereof, either thickened or not and free from oxidizing or reducing agents, onto a dried or partially dehydrated unfixed pad-dyeing produced on said fiber material using a disperse dyestuff of the formula

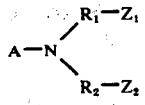

in which

A is a mono or disazo dyestuff residue, $R_1$ is a direct bond, $—CH_2—$ or $—C_2H_4—$, $R_2$ is $—CH_2—$ or $—C_2H_4—$, $Z_1$ is —H, —OH, —CN or $—OOC—CH_2$, and $Z_2$ is —H,

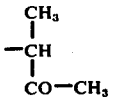

—CN, $—OOC—CH_3$ or $—C_6H_5$, allowing the solution to act on the dyeing, thermosoling the material to fix the dyestuff and finishing it in the usual manner.

2. A process as claimed in claim 1, wherein the alkaline solution used is a solution containing a hydroxide, carbonate or triphosphate of an alkali metal or a mixture thereof, preferably sodium hydroxide or carbonate.

3. A process as claimed in claim 2, wherein the alkaline solution used contains 1 to 25 g/l of sodium hydroxide or 1 to 20 g/l of sodium carbonate or a mixture thereof within this range, corresponding to a pH-value of from 10.5 to 14.

4. A process as claimed in claim 1, wherein for the application of the process to blends of polyester and cellulosic fibers, the padding liquor also contains reactive dyestuffs in addition to the disperse dyestuffs.

5. A process as claimed in claim 1, wherein the alkaline liquor also contains reactive dyestuffs.

6. A process as claimed in claim 1, wherein the alkaline liquor also contains alkali-resistant disperse dyestuffs.

7. A process for obtaining multicolor effects on textiles made of polyester fibers and blends thereof with cellulosic fibers, which comprises locally applying an aqueous solution of an alkaline agent selected from the group consisting of hydroxides, carbonates or triphosphates of alkali metals and mixtures thereof, either thickened or not and free from oxidizing or reducing agents, onto a dried or partially dehydrated unfixed pad-dyeing produced on said fiber material using a disperse dyestuff of the formula

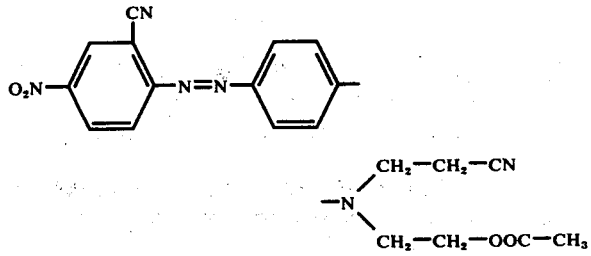

allowing the solution to act on the dyeing to modify the said disperse dye, thermosoling the material to fix the dyestuff and finishing it in the usual manner.

* * * * *